United States Patent [19]

Sorensen

[11] Patent Number: 4,596,126

[45] Date of Patent: Jun. 24, 1986

[54] KEY HOLDER

[76] Inventor: Peter H. Sorensen, 189-18 35th Ave., Flushing, N.Y. 11358

[21] Appl. No.: 619,127

[22] Filed: Jun. 11, 1984

[51] Int. Cl.[4] ..... A47G 29/10

[52] U.S. Cl. ..... 70/456 R

[58] Field of Search ..... 70/456 R, 456 B, 459; 402/63, 80 R; 24/3 K, 67 P, 67.1, 458; D3/61; 150/40

[56] References Cited

U.S. PATENT DOCUMENTS

| | | | |
|---|---|---|---|
| 2,198,110 | 4/1940 | Fischer | 70/456 R |
| 2,778,217 | 1/1957 | Duyn | 70/456 R |
| 3,436,942 | 4/1969 | Procter | 70/456 R |

*Primary Examiner*—Robert L. Wolfe

*Attorney, Agent, or Firm*—Collard, Roe & Galgano

[57] ABSTRACT

A key or article holder for articles which have article-heads, includes a plurality of resilient, generally S-shaped partitions arranged in a pack and disposed in substantially spaced-apart parallel relationship. Each partition is provided with two opposite end portions terminating in opposite directions, which are joined together by a sloping intermediate portion. A plurality of partition spacers, each disposed adjacent the intermediate portions of the partitions maintain the spaced-apart relationship of the partitions. Each of a pair of generally S-shaped resilient side-plates is disposed on an opposite side of the pack of partitions. The end and intermediate portions of the side-plates are in substantial alignment with the end and intermediate portions of the partitions, which define an uninterrupted article-bit receiving channel. The article-heads of a plurality of articles are releasably, pivotably mounted in the article-head receiving slots and are engaged therein by adjustable frictional tension.

13 Claims, 12 Drawing Figures

FIG.1
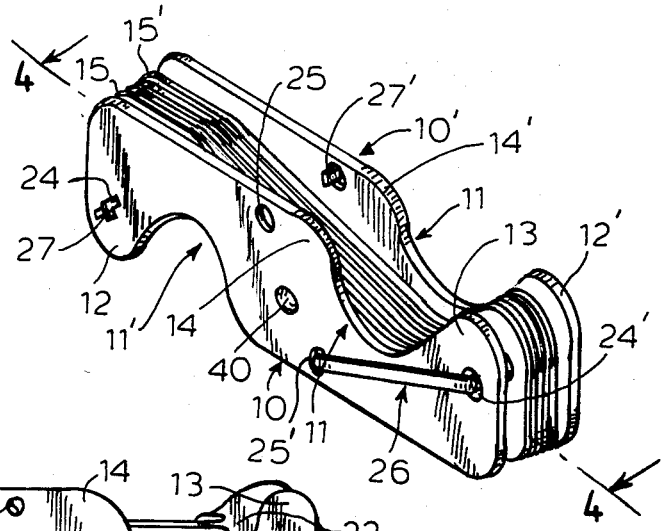
FIG.2
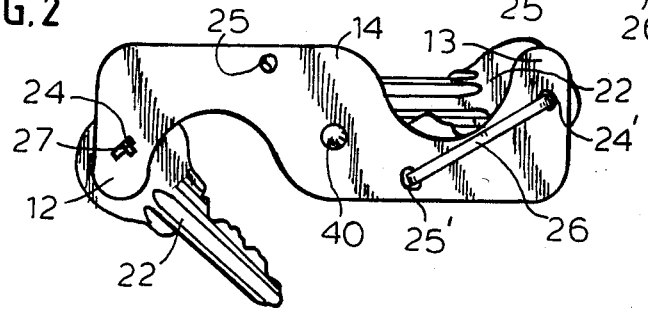
FIG.3
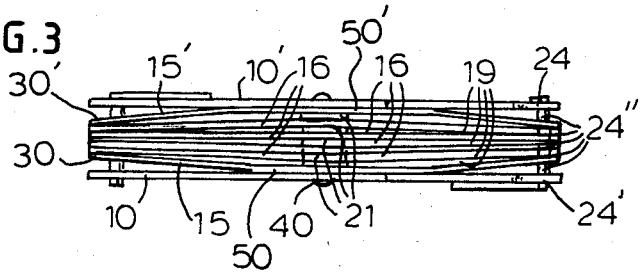
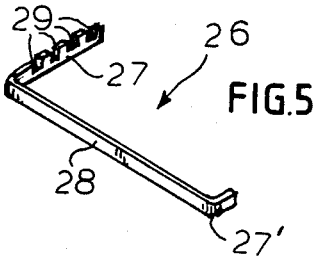
FIG.5
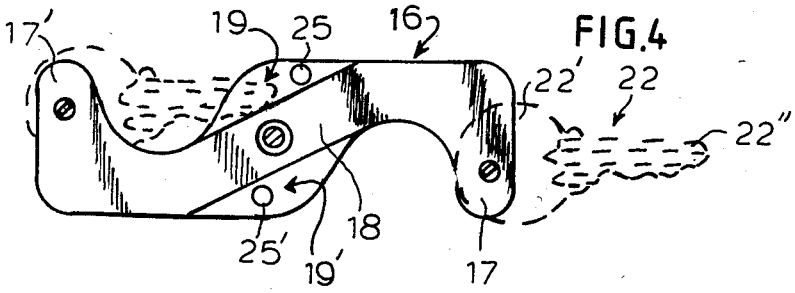
FIG.4

FIG.6
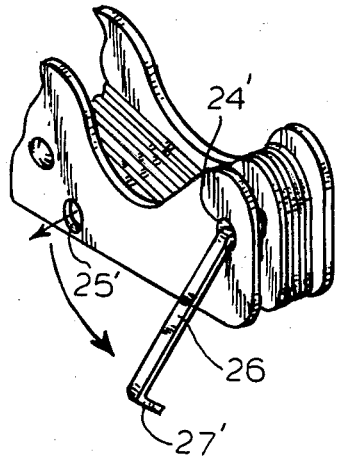
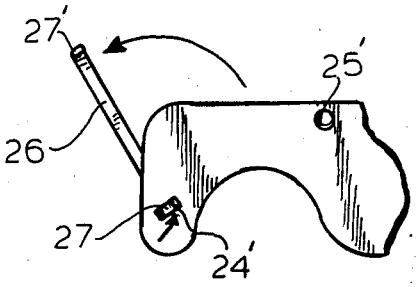
FIG.7
FIG.8
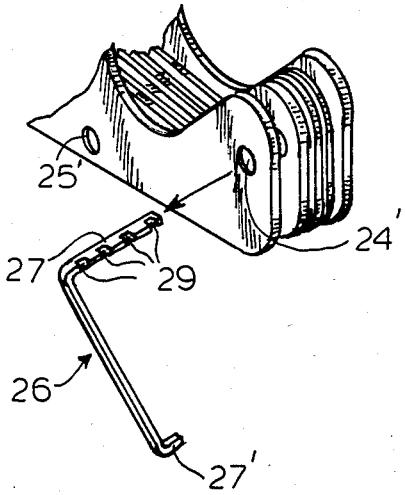

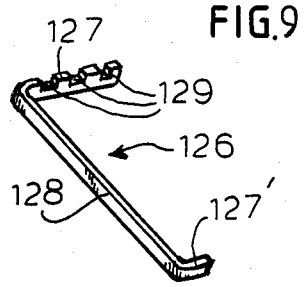
FIG.9
FIG.10
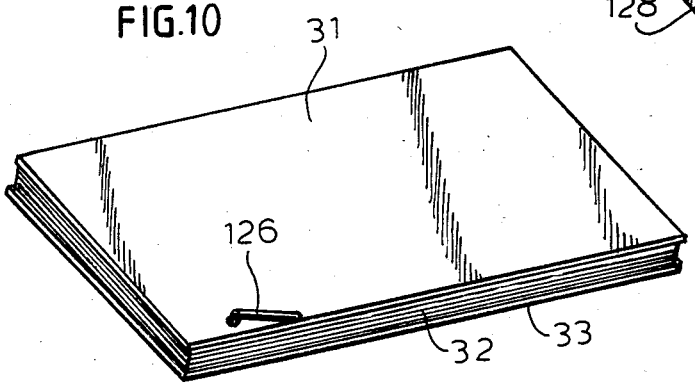
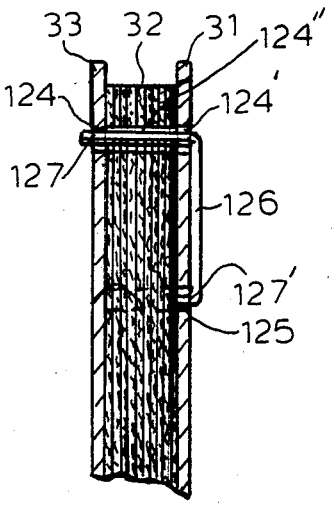
FIG.12
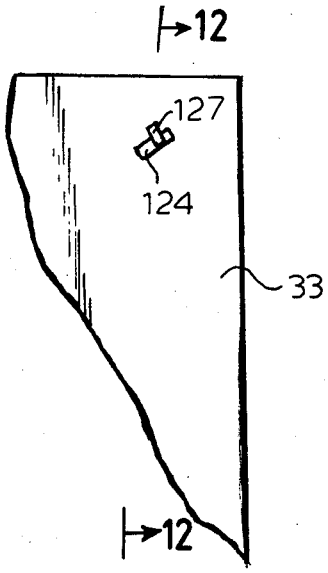
FIG.11

KEY HOLDER

The present invention relates to an article holder adapted to conveniently hold a plurality of articles, such as keys of different shapes and dimensions, so as to permit a ready and facile selection of one of the keys for use and, more particularly, it relates to an improvement in such an article holder.

My prior patent, U.S. Pat. No. 4,352,321, granted Mar. 3, 1981, describes a keyholder which includes a plurality of resilient, generally S-shaped partitions arranged in a pack, and generally disposed in a spaced-apart parallel relationship. A plurality of partition spacers, each disposed between the intermediate portions of an adjacent pair of partitions maintains their spaced-apart relationship. Each partition has two opposite end portions terminating in opposite directions, which are joined together by a sloping intermediate portion. The end portions of adjacent partitions define key-head receiving slots therebetween. Each of a pair of generally S-shaped side-plates is disposed on an opposite side of the pack of partitions, and each of the side-plates has two opposite end portions terminating in opposite directions, which are joined together by a sloping intermediate portion. The end and intermediate portions of the side-plates are in substantial alignment with the end and intermediate portions of the partitions, and the intermediate portions of the side-plates extend laterally outwardly beyond the lateral sides of the intermediate portions of the partitions, so as to define an uninterrupted key bit receiving channel between the laterally extended sideplates. Means for releasably and pivotably securing the key-heads of a plurality of keys in the key-head receiving slots under adjustable frictional tension are provided. This permits the keys to be individually pivoted under a selected degree of frictional tension between a non-operative position, in which the key is maintained within the key-head receiving slot defined by two adjacent partitions with the key-bit thereof lying within the key-bit receiving channel, and an operative position, in which the key-bit is pivoted completely out of the channel.

While the aforedescribed holder of the prior art fulfills all operative requirements demanded of a user, it has been found to be relatively costly to manufacture, particularly due to the fact that the means for providing the adjustable frictional tension for the keys requires the use of a threaded bolt for securing the keys in the key-head receiving slots and maintaining an adjustable tension between opposing side-plates of the holder.

It is, therefore, a primary object of the present invention to provide an improved article holder, particularly for articles such as keys, of the type abovedescribed, which is easier and less expensive to manufacture and which is simpler in operation than heretofore.

The above object, as well as others which will hereinafter become apparent, is accomplished in accordance with the present invention by providing an article holder, for articles which have article-heads for engagement by a holder and article bits, including a plurality of resilient, generally S-shaped partitions arranged in a pack and disposed in substantially spaced-apart parallel relationship. Each partition is provided with two opposite end portions terminating in opposite directions, which are joined together by a sloping intermediate portion. A plurality of partition spacers, each disposed adjacent the intermediate portions of the partitions, maintain the spaced-apart relationship of the partitions. The end portions of adjacent partitions define article-head receiving slots. Each of a pair of generally S-shaped resilient side-plates is disposed on an opposite side of the pack of partitions, each of the side-plates having two opposite end portions terminating in opposite directions which are joined together by a sloping intermediate portion. The end and intermediate portions of the side-plates are in substantial alignment with the end and intermediate portions of the partitions, and the intermediate portions of the side-plates extend laterally outwardly beyond the lateral sides of the intermediate portions of the partitions thereby defining an uninterrupted artic-ebit receiving channel between the lateral extensions of the side-plates. The article-heads of a plurality of articles are releasably, pivotably mounted in the article-head receiving slots and are engaged therein by adjustable frictional tension. The adjustable frictional tension is provided by adjustable biasing means which bias the end portions of the partitions inwardly from the side-plates. The article-heads of the plurality of articles are mounted in the article-head slots by means of a removable key member having a shank portion and a head portion, the shank portion passing through aligned openings in one side-plate and the partitions and through an aligned keyway in the opposite side-plate. The keyway is adapted to accept the key shank in one attitude thereof and a notch near the free end of the shank is adapted to lockingly engage the side-plate at the periphery of the keyway to bind the side-plates between the notch and the key head portion. Releasable means are also provided for securing the key shank in this locked position.

The present invention will be described and understood more readily when considered together with the accompanying drawings, in which:

FIG. 1 is a perspective view of an article holder according to the present invention;

FIG. 2 is a side elevational view of the article holder of FIG. 1, showing two keys mounted therein;

FIG. 3 is a top view of the article holder according to the present invention;

FIG. 4 is a cross-sectional view taken along the line 4—4 of FIG. 1, showing two keys in phantom mounted thereon;

FIG. 5 is a perspective view of the locking key elements of the present invention;

FIG. 6 is a perspective view of a detail of the article holder of FIG. 1, illustrating in particular the operation of the locking key element;

FIG. 7 is a side elevational view of the detail shown in FIG. 6;

FIG. 8 is a perspective view of a detail of the article holder similar to FIG. 6, but with the locking key element removed from the article holder;

FIG. 9 is a perspective view of the locking key element utilized in the embodiment of the invention shown in FIGS. 10 to 12;

FIG. 10 is a perspective view of another embodiment of the article holder of the present invention utilized as a holder of loose sheet-like articles;

FIG. 11 is a bottom view of a detail of FIG. 10; and

FIG. 12 a cross-sectional view taken along line 12—12 of FIG. 11.

Turning now to the drawings, there is shown in FIG. 1 an article holder, which, for purposes of illustration, is shown as a key holder. The holder includes a pair of generally rectangular side plates 10 and 10', each of which has a pair of arcuate notches 11 and 11' formed in upper and lower edges thereof, so as to impart to each side plate 10 and 10' a generally S-shaped configuration defined by respective opposite end portions 12, 13 and 12', 13', respectively, and intermediate portions 14 and 14', respectively. Side-plates 10 and 10' are preferably made from a relatively rigid but somewhat resilient metal. Adjacent side plates 10 and 10' there are disposed two leaf spring elements 15 and 15' which may be similar in shape to the S-shaped side plates 10 and 10'.

Interiorly of leaf spring elements 15 and 15' there are disposed generally S-shaped partitions 16 in a spaced-apart parallel relationship. Each partition 16 has two opposite end portions 17 and 17' terminating in respective opposite directions, which are joined together by a sloping intermediate portion 18, as clearly seen in FIG. 4. The end portions 17 and 17' of adjacent partitions 16, as clearly seen in FIG. 3, define article-head receiving slots 19 therebetween. End portions 12, 13 and 12', 13' of side-plates 10 and 10', respectively, are in substantial alignment with end portions 17 and 17' of partitions 16. Intermediate portions 14 and 14' of side-plates 10 and 10' extend laterally outwardly beyond the sides of intermediate portions 18 of partitions 16, so as to define an uninterrupted article receiving channel 19' between the lateral extensions of intermediate portions 14 and 14' of side-plates 10 and 10'. There are provided a plurality of partition spacers 21, each disposed adjacent the intermediate portions 18 of partitions 16, so as to separate partitions 16 from one another. Each article, for example a key 22, will have an article-head, for example a key-head 22', and means are provided for releasably and pivotably securing the article-heads of a plurality of articles in the article-head receiving slots 19 under adjustable frictional tension. This permits the articles, such as the keys 22, to be individually pivoted under a selected degree of frictional tension between a non-operative position, in which a functional article portion, such as key-bit 22'', lies within uninterrupted receiving channel 19', and an operative position, in which the functional article portion is pivoted completely out of the channel.

Each end portion 12 and 12' of each S-shaped side-plate 10 and 10' is formed with a rectangular opening or keyway 24, and each end portion 13 and 13' is formed with a generally circular opening 24'. Corresponding openings 24'' are also formed in leaf spring elements 15, 15' and in partitions 16. Openings 24, 24' and 24'' are generally aligned with one another. Each intermediate portion 14, 14' of each S-shaped side plate 10, 10' is formed with apertures 25 and 25' spaced near, and at a predetermined distance from openings 24' formed in the end portions 13 and 13' of the corresponding S-shaped side-plates 10 and 10'.

The arrangement for releasably and pivotably securing the article-heads, such as key-heads 22' of keys 22 in the article-head receiving slots 19 includes, as clearly seen in FIG. 5, a key element 26 having a shank member 27 adapted to extend through openings 24', 24'' and 24. Shank 27 preferably is provided with a rectangular cross-section compatible with keyway 24 so as to allow insertion therethrough in only one attitude of shank 27 and with a length about equal to the distance between side-plates 10 and 10'. At least one and preferably a plurality of notches 29 are provided along the length of shank 27 near one end thereof for the purpose of lockingly engaging side-plate 10 or 10' at the periphery of keyway 24 when shank 27 is inserted into keyway 24 and turned or rotated therein. Key element 26 is also provided with an arm 28 which is substantially at right angles to shank 27 at the end of which is a projection or tang 27' extending inwardly at right angles to arm 28. Arm 28 and notch 29 of key shank 27 cooperate to bind or clasp side-plates 10 and 10' together and arm 28 and projection 27' cooperate to maintain the locking engagement of a notch 29 with the opposing side-plate at the periphery of keyway 24. Projection 27' is adapted to be engaged by aperture 25' as shank 27 is rotated in openings 24' and 24'' and notch 29 is thus lockingly engaged at keyway 24. In this manner, shank 27 is maintained in locking engagement with keyway 24. Thus, the predetermined distance between aperture 25' and opening 24' is about equal to the length of arm 28 of key element 26.

The means for engaging the article-heads, such as key-heads 22', in the article-head receiving slots 19 under adjustable frictional tension includes the aforedescribed two leaf spring elements 15 and 15', which may be similar in shape to the shape of article partitions 16. Leaf spring elements 15 and 15' are provided with substantially flat center portions 50 and 50', respectively, and angled end portions 30 and 30', respectively. End portions 30 and 30' are cantilevered from the intersection of center portions 50, 50' and end portions 30, 30'. Leaf spring elements 15 and 15' are positioned adjacent side-plates 10 and 10', respectively, and their ends 30 and 30' exert an inwardly directed biasing action against the interiorly positioned partitions 16. As clearly seen in FIG. 3, for the purpose of taking the greatest advantage of the spring pressure of leaf springs 15 and 15', no spacers 21 are positioned between the leaf springs and their respective adjacent side-plates.

The purpose of providing shank 27 of key element 26 with a plurality of notches 29 is to permit the end portion 12 or 12' of the side plate 10 or 10', respectively, at the periphery of rectangular slot 24 to be selectably engaged with one of the notches 29 depending on the degree of tension desired to be exerted on partitions 16 by leaf spring elements 15 and 15'. Thus, as resilient side-plates 10 and 10' are brought closer together by the selection of appropriate notches 29 of shank 27 and because of the increased cantilever action on end portions 30 and 30' resulting therefrom, leaf spring elements 15 and 15' exert a correspondingly increased inwardly directed pressure against partitions 16. This increased pressure results in greater frictional tension at article-head receiving slots 19.

Side plates 10 and 10', article partitions 16, leaf spring elements 15 and 15', and partition spacers 21 are advantageously connected to one another, by any suitable means such as rivet 40, approximately at the respective centers thereof.

In operation, key element 26 is removed from the article holder by disengaging projection 27' thereof from aperture 25' and rotating key element 26 until notch 29 is disengaged from the periphery of keyway 24 and shank 27 is in the proper attitude for removal from keyway 24, as clearly demonstrated in FIGS. 6 and 7. Key element 26 can then be withdrawn from openings 24' and 24'', as clearly demonstrated in FIG. 8. Once key element 26 is removed from the holder, articles, such as keys, can be positioned so that their article-heads are within article-head receiving slots 19. Key element 26 can then be replaced in the holder by reversing the abovedescribed sequence resulting in the articles, such as keys 22, being pivotably held in the holder as seen in FIG. 2. Selecting the desired frictional tension on the article-heads is accomplished by selecting the appropriate notch 29 of key element 26 for engagement within keyway 24. Thus, choosing a notch 29 closer to arm 28 and effectively shortening shank 27, will bring the end portions 12 and 13' (or 12' and 13) of side-plates 10 and 10' closer together thereby flattening and increasing the tension provided by leaf-type springs 15 and 15'.

It will be understood that although a key 22 has been given as an example of an article which can be used in the article holder according to the present invention, it is equally possible to use tools, for example leaf type gages, wrenches, etc., for the articles in the article holder of the present invention.

Furthermore, the holder of the present invention is not necessarily limited in application to that of an article holder. Thus, for example, the holder can be used to lock together two hard-covers 31 and 33 protecting each side of a pack of loose sheets 32, as seen in FIGS. 10 to 12. It will often be found advantageous to connect longitudinal edge portions of the sheets 32 and longitudinal edge portions of the covers 31 and 33 to one another. Openings 124'' are formed in sheets 32 along the edge portions thereof, and one opening 124 in the cover 33 is formed as a substantially rectangular slot or keyway. Analogous to the apertures 25 or 25', there is formed an aperture 125 in the hard cover 31. Aperture 125 is spaced at a predetermined distance from the opening 124' substantially equal to the length of arm 128 of key element 126.

Key element 126 having shank 127 and projection or tang 127', and which is used as a locking means to hold the covers 31 and 33 together will not be described in detail as it corresponds in form and function to key element 26 described above, as clearly seen in FIG. 9.

It is to be understood that the foregoing general and detailed descriptions are explanatory of the present invention and are not to be interpreted as restrictive of the scope of the following claims.

What is claimed is:

1. An article holder for holding a plurality of articles, said articles having article-heads for engagement by said holder, said article holder including:

(a) a plurality of resilient, generally S-shaped partitions arranged in a pack and generally disposed in spaced-apart, parallel relationship, each of said partitions having two opposite end portions terminating in opposite directions which are joined together by a sloping intermediate portion, said end portions of adjacent partitions defining individual article-head receiving slots therebetween;

(b) a plurality of partition spacers, each of which is disposed adjacent the intermediate portions of said partitions;

(c) a pair of generally S-shaped resilient side-plates, each of which is disposed on an opposite side of said pack of partitions, each of said side-plates having two opposite end portions terminating in opposite directions which are joined together by a sloping intermediate portion, said end and intermediate portions of said side-plates being in substantial alignment with said end and intermediate portions of said partitions, and said intermediate portions of said side-plates extending laterally outwardly beyond the lateral sides of the intermediate portions of said partitions so as to define an uninterrupted article receiving channel between the lateral outward extensions of the intermediate portions of said side-plates;

(d) means biasing the end portions of said partitions, defining article-head receiving slots therebetween, inwardly from said side-plates so that frictional tension is exerted on the article-heads of articles within said article-head receiving slots; and (e) releasable means for pivotably mounting said plurality of articles at the article-heads thereof and for adjusting the biasing action of said biasing means to thereby adjust the frictional tension acting on the article-heads so as to permit said articles to be individually pivoted under a selected degree of frictional tension between a non-operative position, in which the article lies within said uninterrupted article receiving channel, and an operative position, in which said article is pivoted completely out of said channel.

2. The article holder as defined in claim 1, wherein said biasing means includes a plurality of springs, a pair each of which acts upon the opposite sides of said pack of partitions at the end portions thereof.

3. The article holder as defined in claim 2, wherein said releasable means for pivotably mounting said plurality of articles and for adjusting the biasing action of said springs includes:

(a) a key element having a shank portion whose length is about equal to the distance between said side-plates and a head portion at one end of said shank portion;

(b) an opening in the end portion of at least one of said side-plates, aligned with similar openings in said partitions for accepting the shank portion of said key element and causing said head portion of said key element to abut against said side-plate;

(c) a keyway in said other side-plate aligned with said openings adapted to accept the shank portion of said key element in one attitude thereof;

(d) at least one notch provided in said shank portion near the free end thereof so that when said shank portion is turned in said keyway, said notch lockingly engages the periphery thereof; and (e) means for releasably securing the position of said shank portion in said keyway so as to maintain the locking engagement of said notch with the periphery of said keyway.

4. The article holder as defined in claim 3, wherein the means for releasably securing said shank portion in locking engagement with said keyway includes an inwardly directed projection in said head portion of said key element engageable with a complementary recess in said side-plate against which said head portion abuts.

5. The article holder as defined in claim 4, wherein the head portion of said key element is an arm substantially at right angles to said shank portion for abutting against said side-plate and said projection therefrom is a tang receivable in an opening in said side-plate.

6. The article holder as defined in claim 3, wherein said plurality of springs includes a pair of leaftype springs each of which is disposed on an opposite side of said pack of partitions having a center portion adjacent to its respective side-plate and end portions which are cantilevered from said center portions and extend inwardly toward the end portions of said partitions thus exerting a biasing action thereon.

7. The article holder as defined in claim 6, wherein the shank portion of said key element is provided along its length with a plurality of notches engageable with the periphery of said keyway so that engagement of differing ones of said notches with the periphery of said keyway results in differing relative positions of said side-plates one with the other and differing cantilevering action on the end portions of said leaf springs resulting in differing spring forces.

8. The article holder as defined in claim 6, wherein said side-plates, said partitions, said partition spacers, and said leaf-type springs are connected to one another approximately at the respective centers thereof.

9. An article holder for holding a plurality of articles, said articles having article-heads for engagement by said holder, said article holder including:

(a) a plurality of resilient, generally S-shaped partitions arranged in a pack and generally disposed in spaced-apart, parallel relationship, each of said partitions having two opposite end portions terminating in opposite directions which are joined together by a sloping intermediate portion, said end portions of adjacent partitions defining individual article-head receiving slots therebetween;

(b) a plurality of partition spacers, each of which is disposed adjacent the intermediate portions of said partitions;

(c) a pair of generally S-shaped resilient side-plates, each of which is disposed on an opposite side of said pack of partitions, each of said side-plates having two opposite end portions terminating in opposite directions which are joined together by a sloping intermediate portion, said end and intermediate portions of said side-plates being in substantial alignment with said end and intermediate portions of said partitions, and said intermediate portions of said side-plates extending laterally outwardly beyond the lateral sides of the intermediate portions of said partitions so as to define an uninterrupted article receiving channel between the lateral outward extensions of the intermediate portions of said side-plates;

(d) a key element having a shank portion whose length is about equal to the distance between said side-plates and a head portion at one end of said shank portion, said shank portion being acceptable in an opening in one of said side-plates and aligned openings in said partitions, and said head portion abutting against said side-plate, said shank portion being acceptable in one attitude in an aligned keyway in said other side-plate;

(e) at least one notch provided in said shank portion near the free end thereof so that when said shank portion is turned in said keyway, said notch lockingly engages the periphery thereof; and (f) means for releasably securing the position of said shank portion in said keyway so as to maintain the locking engagement of said notch with the periphery of said keyway.

10. The article holder as defined in claim 9, wherein the means for releasably securing said shank portion in locking engagement with said keyway includes an inwardly directed projection in said head portion of said key element engageable with a complementary recess in said side-plate against which said head portion abuts.

11. The article holder as defined in claim 10, wherein the head portion of said key element is an arm substantially at right angles to said shank portion for abutting against said side-plate and said projection therefrom is a tang receivable in an opening in said side-plate.

12. The article holder as defined in claim 11, wherein the shank portion of said key element is provided along its length with a plurality of notches engageable with the periphery of said keyway so that engagement of differing ones of said notches with the periphery of said keyway results in differing relative positions of said side-plates one with the other.

13. The article holder as defined in claim 9, wherein said side-plates, said partitions, and said partition spacers are connected to one another approximately at the respective centers thereof.

* * * * *